US011130615B2

(12) United States Patent
McCambridge et al.

(10) Patent No.: US 11,130,615 B2
(45) **Date of Patent: *Sep. 28, 2021**

(54) ENVELOPE-SHAPED POCKET IN GIFT BAG

(71) Applicant: HALLMARK CARDS, INCORPORATED, Kansas City, MO (US)

(72) Inventors: Emiley Irene McCambridge, Kansas City, MO (US); Carly Nichole Unger, Kansas City, MO (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/798,042

(22) Filed: Oct. 30, 2017

(65) Prior Publication Data

US 2018/0057216 A1 Mar. 1, 2018

Related U.S. Application Data

(63) Continuation of application No. 15/141,139, filed on Apr. 28, 2016, now Pat. No. 9,802,734.

(51) Int. Cl.

| | |
|---|---|
| ***B65D 33/00*** | (2006.01) |
| ***B65D 33/12*** | (2006.01) |
| ***B65D 30/22*** | (2006.01) |

(52) U.S. Cl.

CPC ..... *B65D 33/004* (2013.01); *B65D 31/12* (2013.01); *B65D 33/12* (2013.01)

(58) Field of Classification Search

CPC ..... B65D 33/004; B65D 31/12; B65D 33/12

USPC ..... 383/38–40; 229/72

See application file for complete search history.

(56) References Cited

U.S. PATENT DOCUMENTS

| | | | | |
|---|---|---|---|---|
| 560,469 | A | 5/1896 | Butts et al. | |
| 1,574,058 | A * | 2/1926 | Redington | B65D 27/04 229/72 |
| 2,049,113 | A * | 7/1936 | Formoso | B65D 43/12 206/1.5 |
| 4,648,860 | A | 3/1987 | Cassey | |
| 4,991,980 | A | 2/1991 | Cohen et al. | |
| 5,836,095 | A | 11/1998 | Crowell | |
| 7,222,446 | B2 * | 5/2007 | Foster | G09F 1/04 40/124.06 |

(Continued)

FOREIGN PATENT DOCUMENTS

| | | | |
|---|---|---|---|
| DE | 3716556 A1 | 11/1987 | |
| DE | 29512795 U1 * | 10/1995 | B65D 33/004 |

(Continued)

OTHER PUBLICATIONS

Machine translation of the description of DE 2951795 U1.*

(Continued)

*Primary Examiner* — Jes F Pascua

(74) *Attorney, Agent, or Firm* — Shook, Hardy & Bacon LLP

(57) ABSTRACT

A gift bag having an envelope-shaped pocket therein for transporting and presenting an envelope, card, or other merchandise with the gift bag is provided. The pocket may be integrally formed with the gift bag, or at least partially formed from a separately attached piece, and may be positioned at various locations within the bag. The pocket may also be formed to look like an envelope.

6 Claims, 6 Drawing Sheets

(56) References Cited

U.S. PATENT DOCUMENTS

| | | | | |
|---|---|---|---|---|
| 7,900,814 | B2 | 3/2011 | McBride | |
| 8,011,500 | B2 | 9/2011 | Lee | |
| D747,217 | S * | 1/2016 | Glass | D9/703 |
| 9,802,734 | B1 * | 10/2017 | McCambridge | B65D 33/004 |
| 2006/0086014 | A1 | 4/2006 | Plank et al. | |
| 2007/0201772 | A1 | 8/2007 | Schindele | |
| 2008/0199107 | A1 | 8/2008 | Nicholson | |
| 2009/0238499 | A1 | 9/2009 | Steele | |
| 2009/0314677 | A1 | 12/2009 | Teggatz et al. | |
| 2010/0177986 | A1 | 7/2010 | Kohn et al. | |
| 2010/0230306 | A1 | 9/2010 | Dana | |
| 2014/0033651 | A1 | 2/2014 | Cunningham | |
| 2015/0210434 | A1 | 7/2015 | Miller | |

FOREIGN PATENT DOCUMENTS

| | | | |
|---|---|---|---|
| GB | 2211079 | A | 6/1989 |
| JP | 2007313277 | A * | 12/2007 |

OTHER PUBLICATIONS

Machine translation of JP-2007313277-A.*
Office Action dated Oct. 13, 2017 in Canadian Patent Application No. 2,937,851, 3 pages.

* cited by examiner

ENVELOPE-SHAPED POCKET IN GIFT BAG

CROSS-REFERENCE TO RELATED APPLICATIONS

This is a continuation application that claims priority benefit of co-pending U.S. patent application Ser. No. 15/141,139, filed Apr. 28, 2016, and entitled "Envelope-Shaped Pocket in Gift Bag," the contents of which is incorporated herein by reference in the entirety.

STATEMENT REGARDING FEDERALLY SPONSORED RESEARCH OR DEVELOPMENT

Not applicable.

TECHNICAL FIELD

The present invention generally relates to gift bags. More specifically, the present invention relates to gift bags having a pocket therein.

SUMMARY

This summary is provided to introduce a selection of concepts in a simplified form that are further described below in the detailed description section of this disclosure. This summary is not intended to identify key or essential features of the claimed subject matter, nor is it intended to be used as an aid in determining the scope of the claimed subject matter.

In brief, and at a high level, this disclosure describes, among other things, a gift bag having a pocket formed therein for transporting and presenting an envelope, card, or other merchandise with the gift bag. The pocket may be integrally formed with the gift bag, or at least partially formed from a separately attached piece. The pocket may be located at various positions relative to an upper edge of the bag to allow a desired presentation. The pocket may also be formed to look like an envelope.

In one embodiment a bag is provided. The bag includes a base, one or more side walls extending from the base to an upper edge, the upper edge circumscribing a first opening into a first interior compartment of the bag, the one or more side walls having an interior surface and an exterior surface, and a pocket located on the interior surface of one or more of the side walls and comprising a second opening into a second interior compartment.

In another embodiment a bag is provided. The bag includes a base, one or more side walls extending from the base to an upper edge, the upper edge circumscribing a first opening into a first interior compartment in the bag, the one or more side walls having an interior surface and an exterior surface, and a pocket located on the interior surface adjacent the upper edge, the pocket comprising an opening edge that at least partially circumscribes a second opening into a second interior compartment in the pocket.

In another embodiment a method of manufacturing gift bags is provided. The method includes providing a bag having a base and one or more side walls extending from the base to an upper edge, the upper edge circumscribing a first opening into a first interior compartment in the bag, the one or more side walls having an interior surface and an exterior surface, and coupling a separate piece to the interior surface adjacent the upper edge to form a pocket.

BRIEF DESCRIPTION OF THE DRAWINGS

The present invention is described in detail below with reference to the attached drawing figures, which are intended in all aspects to be exemplary and non-limiting in nature, wherein.

DETAILED DESCRIPTION

The subject matter of the present invention is described with specificity herein to meet statutory requirements. However, the description itself is not intended to limit the scope of the invention. Rather, the claimed subject matter may be embodied in other ways, to include different elements, steps, or combinations of elements or steps, similar to the ones described in this disclosure, in conjunction with other present or future technologies. Moreover, although the terms "step" or "block" may be used herein to connote different elements of various methods employed, the terms should not be interpreted as implying any particular order among or between various steps or blocks unless and except when the order of individual steps or blocks is explicitly described and required.

At a high level, the present invention relates generally to a gift bag having a pocket formed therein. The pocket may be used to receive a greeting card, envelope, or other item for transport and presentation with the gift bag. The pocket includes an opening adjacent an upper edge of the bag, to allow the card, envelope, or item received therein to be visible when transported or presented with the bag. Exemplary embodiments of such a gift bag are described in greater detail below with respect to FIGS. 1-7.

Figure 1:
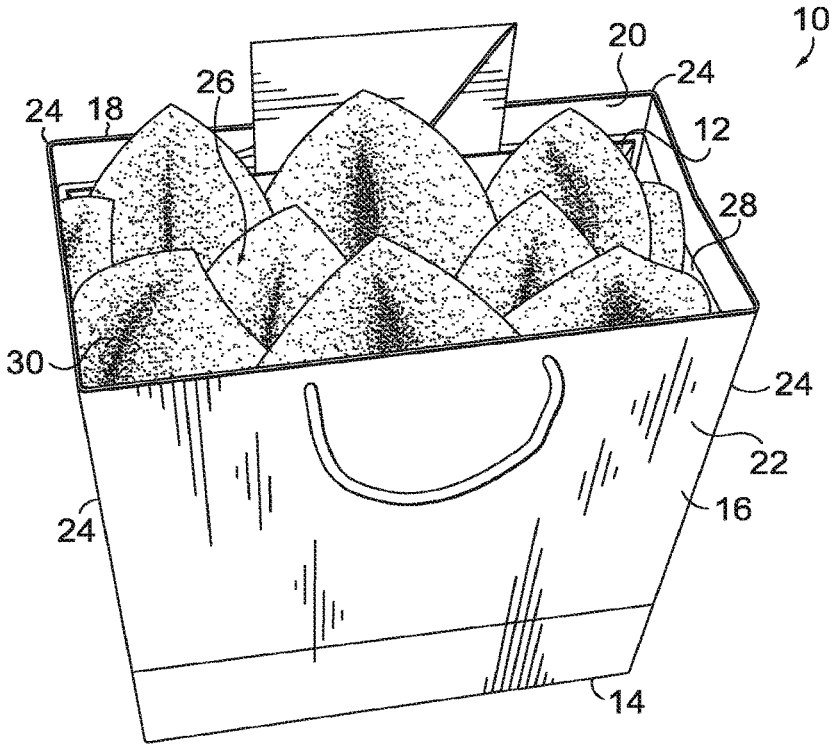
FIG. 1 depicts a top perspective view of a gift bag with an envelope-shaped pocket therein and decorated to be given as a gift, in accordance with an embodiment of the present invention.

Referring to FIG. 1, a top perspective view of a gift bag 10 with an envelope-shaped pocket 12 formed therein is provided, in accordance with an embodiment of the present invention. In FIG. 1, the bag 10 includes a base 14 and one or more side walls 16 extending from the base 14 to an upper edge 18. The one or more side walls 16 include an interior surface 20 and an exterior surface 22. FIG. 1 shows four side walls generally separated by corner edges 24, although more or fewer walls (e.g., one unified wall) with more or fewer corner edges are possible and contemplated. The upper edge 18 circumscribes a first opening 26 into a first interior compartment 28 of the bag 10. The bag 10 in FIG. 1 further includes merchandise and or decorations (such as tissue paper to cover a present) 30 and/or other items placed in the first interior compartment 28.

Figure 2:
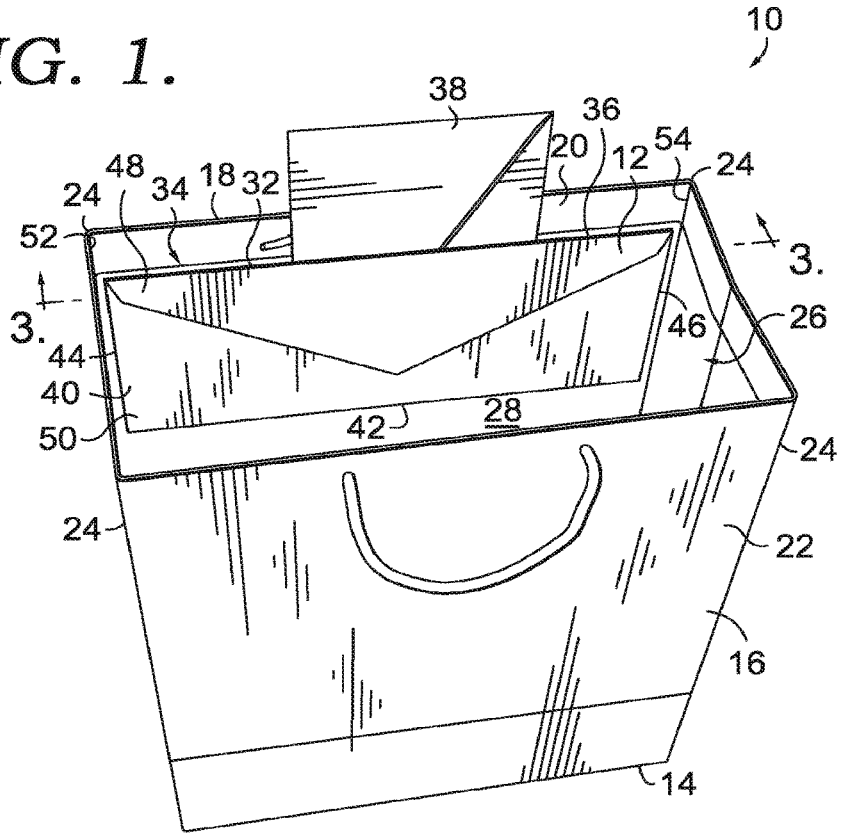
FIG. 2 depicts the gift bag of FIG. 1 with the decorative tissue paper removed to more clearly show the envelope-shaped pocket, as well as an envelope positioned therein.

Referring to FIG. 2, the bag 10 of FIG. 1 is shown with the merchandise 30 removed. The pocket 12 is at least partially located and/or formed on the interior surface 20 of the one or more side walls 16 within the bag 10. Additionally, the pocket 12 includes an opening edge 32 that forms at least a portion of a second opening 34 into a second interior compartment 36 inside the pocket 12 (the opening edge 32, the second opening 34, and the second interior compartment 36 are more clearly depicted in FIG. 6). The opening edge 32 is located adjacent the upper edge 18 of the one or more side walls 16, as explained further below.

As used in this disclosure with respect to the opening edge 32 and the upper edge 18, "adjacent" shall mean that the opening edge 32 and the upper edge 18 are either coplanar, or alternatively, within six inches of each other on the bag 10. For example, the opening edge 32 and the upper edge 18 may both be coplanar, such that the opening edge 32 and the upper edge 18 are roughly an equal distance from the base 14. It may even be the case that the upper edge 18 forms a portion of the second opening 34 into the second interior compartment 36 of the pocket 12, being located opposite the opening edge 32. Alternatively, the opening edge 32 may be from almost zero to six inches below the upper edge 18 on the interior surface 20 of the bag 10, for example. The distance between the opening edge 32 and the upper edge 18 may be selected to allow a portion of an envelope 38, or other items placed into the pocket 12, to be at least partially obscured within the first and second interior compartments 28, 36.

The pocket 12 may be integrally formed within the one or more side walls 16 of the bag 10 (e.g., formed during construction of the bag 10), or may be formed of a composite construction, as shown in FIG. 2, where at least one separate piece 40 is attached to the interior surface 20 of the one or more side walls 16 to form the pocket 12. The separate piece 40 may be coupled to the interior surface 20 of the wall, such as with an adhesive or other bonding method. The pocket 12 includes the opening edge 32, which is opposite a parallel bottom edge 42, and a left edge 44, which is opposite a parallel right edge 46. The separate piece 40 shown in FIG. 2 is provided as a rectangular shape, but may be a square, parallelogram, or another shape. The pocket 12 depicted in FIG. 2 also includes an envelope flap 48 that is coupled to an exterior pocket surface 50 of the separate piece 40, to give the pocket 12 the appearance of an envelope.

In the embodiment illustrated in FIG. 2, the separate piece 40 shown in FIG. 2 is sized and positioned on the interior surface 20 such that the opening edge 32 is slightly spaced from the upper edge 18. The opening edge 32, bottom edge 42, and upper edge 18 may also be parallel to each other, as shown in FIG. 2. Additionally, the left edge 44 is parallel to a first corner edge 52 of the one or more side walls 16 and adjacent to the first corner edge 52 (i.e., within at least three inches of the first corner edge 52), and the right edge 46 is parallel to a second corner edge 54 of the one or more side walls 16 and adjacent to the second corner edge 54 (i.e., within three inches of the second corner edge 54). In exemplary embodiments, the left and right edges 44, 46 may be spaced any distance from the respective first and second corner edges 52, 54, or may be at the same locations as the respective first and second corner edges 52, 54.

It should be noted that in addition to the separate piece 40 shown in FIG. 2, one or more additional separate pieces, in separate locations or stacked or coupled on top of each other (e.g., multiple separate pieces with left edges 44, right edges 46, and bottom edges 42 coupled to join the separate pieces), may be provided and coupled to the interior surface 20 to provide multiple pockets for receiving and holding items. Although the envelope 38 is shown in FIG. 2, a card, stationary, or other items or merchandise may be positioned in the pocket 12 for presentation with the bag 10.

The opening edge 32 may form all of the second opening 34 or at least a portion of the second opening 34, with the remaining portion being provided by part of the interior surface 20 across from the opening edge 32, or by the upper edge 18, if the upper edge 18 and opening edge 32 are coplanar. Further, the separate piece 40 may be formed of the same material or of a different material than the one or more side walls 16 (e.g., may be card stock, plastic, or paper). Additionally, separate pockets of a similar or varied construction as pocket 12 may be positioned on one wall or multiple walls of the one or more side walls 16 for holding additional items or merchandise, if desired.

Figure 3:
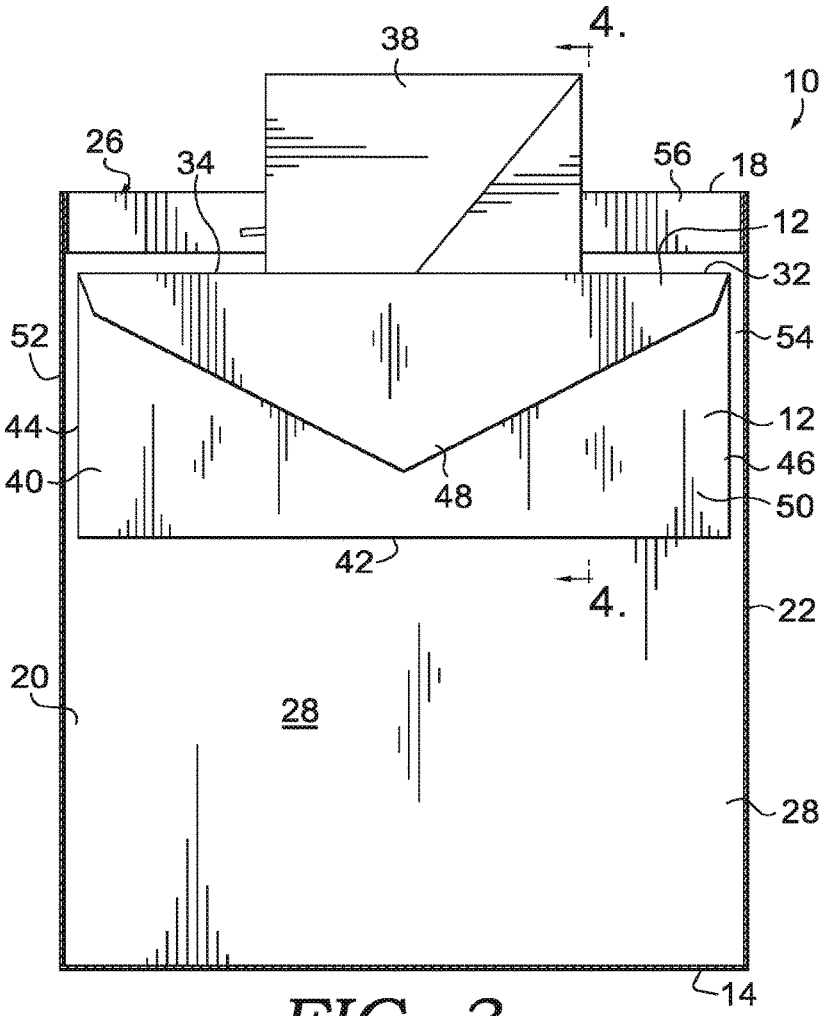
FIG. 3 depicts a cross-sectional view of the gift bag of FIG. 2 taken along the line 3-3.

Referring to FIG. 3, a cross-sectional view of the gift bag 10 depicted in FIG. 2 taken along cut-line 3-3 is provided, in accordance with an embodiment of the present invention. FIG. 3 depicts the interior surface 20, the separate piece 40 forming at least a portion of the pocket 12, the envelope 38, and the envelope flap 48 coupled to the exterior pocket surface 50. As shown in FIG. 3, the opening edge 32 of the pocket 12 is located adjacent to the upper edge 18 such that the edges 18, 32 are not coplanar, but rather are in spaced-apart relation. Additionally, the left edge 44 is adjacent to the first corner edge 52 and the right edge 46 is adjacent to the second corner edge 54. The pocket 12 is shown receiving a portion of the envelope 38, allowing a remaining portion of the envelope 38 to stick up past the upper edge 18 for display outside of the gift bag 10. The upper edge 18 further includes a folded over edge 56 (which may also be a supplementary coupled piece) for reinforcement around the upper edge 18 (e.g., to prevent ripping by an attached handle and/or to present a folded over upper edge 18).

Figure 4:
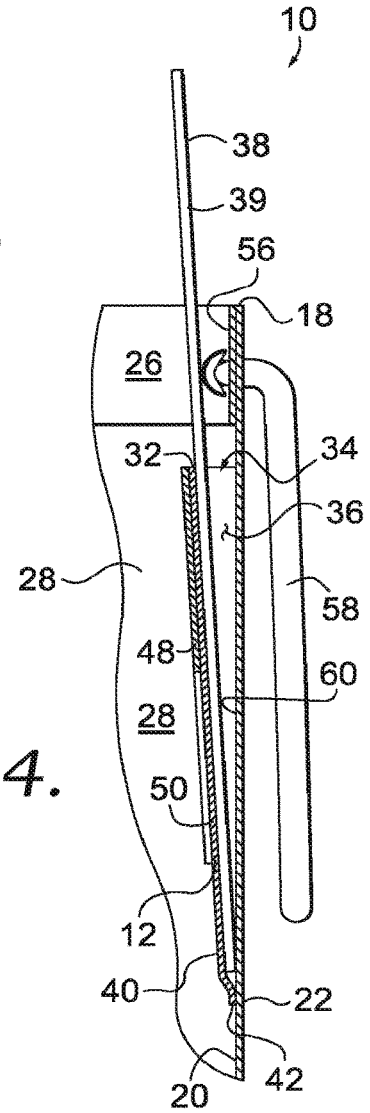
FIG. 4 is a fragmentary cross-sectional view of the gift bag depicted in FIG. 3 taken along cut-line 4-4.

Referring to FIG. 4, a fragmentary cross-sectional view of the gift bag 10 taken along cut-line 4-4 in FIG. 3 is provided. FIG. 4 provides a partial view of the first interior compartment 28 and the second interior compartment 36 of the bag 10, which is shown receiving a portion of the envelope 38. Further, a portion 39 of the envelope 38 extends out of the second interior compartment 36, out of the first interior compartment 28, through the first opening 26, and above the upper edge 18 of the one or more side walls 16. Additionally, coupled to the one or more side walls 16 adjacent the upper edge 18 is a handle 58 for carrying the bag 10. The envelope flap 48, in this embodiment, is shown coupled to the exterior pocket surface 50 of the separate piece 40 (the envelope flap 48 may also be integrally formed with the exterior pocket surface 50). The second interior compartment 36 is generally bounded by the exterior pocket surface 50, an interior pocket surface 60 (which may be a portion of the interior surface 20 of the bag 10 or another part of the separate piece 40 that is coupled to the interior surface 20), and the bottom edge 42 of the separate piece 40.

Figure 5:
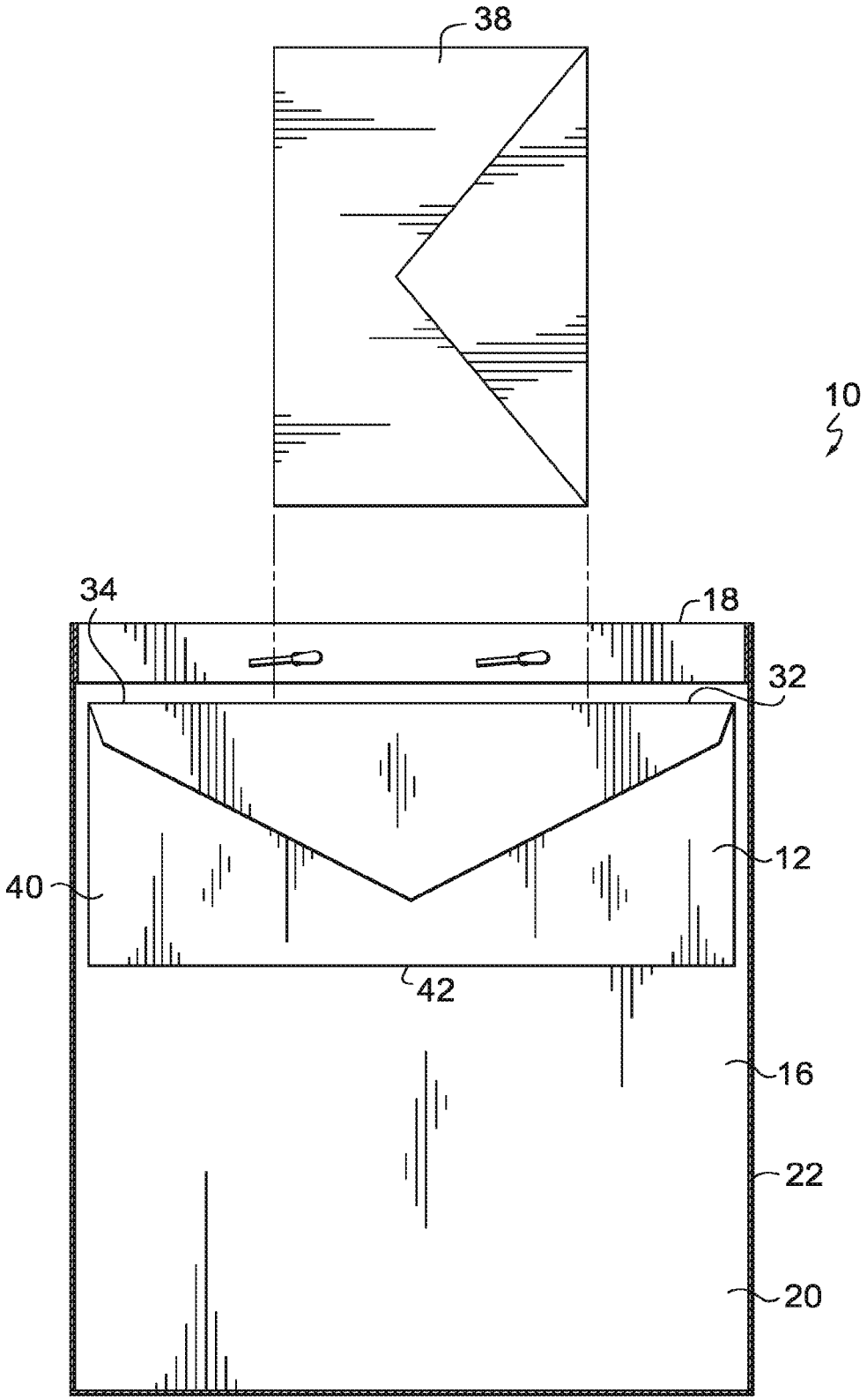
FIG. 5 depicts the cross-section view of the gift bag of FIG. 3 with a separately provided envelope removed.

Referring to FIG. 5, the cross-sectional view of the gift bag 10 depicted in FIG. 3 with the envelope 38 removed is provided, in accordance with an embodiment of the present invention. FIG. 5 once again depicts the cross-section of the bag 10 taken along cut line 3-3 of FIG. 2, with the envelope 38 removed from the second interior compartment 36 of the pocket 12. The pocket 12 further includes the opening edge 32 and the bottom edge 42 being spaced apart a selected distance (e.g., by at least 2, at least 3, or at least 4 inches).

It should be noted that the dimensions of the gift bag 10 and the envelope-shaped pocket 12, as well as their relationship to each other, need not be as illustrated. The gift bag 10 may be larger or smaller in general and in relation to the pocket 12. The gift bag 10 may also be wider (e.g., more square) or narrower, as well as shallower or deeper. Similarly, the pocket 12 may be larger or smaller in general and in relation to the gift bag 10. The pocket may also be wider or narrower (e.g., more square), as well as shallower or deeper. By way of an example only, and not as a limitation, one example size of the pocket 12 is approximately 7" wide by 4.5" deep or tall. In an embodiment of the invention where a separate piece 40 of those dimensions is glued to the interior surface 20 of the sidewall 16 with a glue surface area 64 (FIG. 7) of approximately ½" around a perimeter of the interior pocket surface 60 on a rear of the separate piece 40 (i.e., reverse side of the separate piece 40 from the side with the envelope flap 48), the second interior compartment 36 is approximately 6.5" wide by 4" deep.

Figure 6:
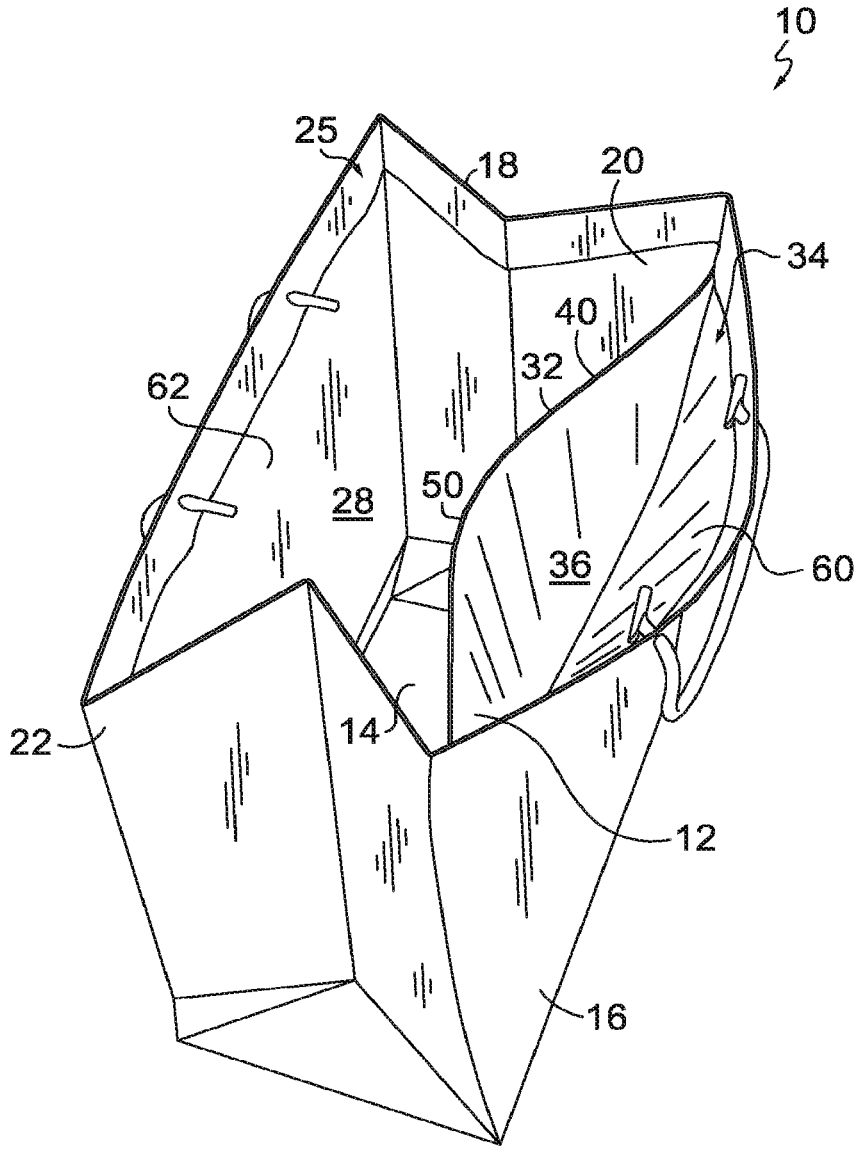
FIG. 6 is a top perspective view of the gift bag of FIG. 2 with the pocket pulled open for insertion of an envelope, card or other merchandise.

Referring to FIG. 6, a top perspective view of the gift bag 10 of FIG. 2 with the envelope 38 removed and the pocket 12 pulled open is provided, in accordance with an embodiment of the present invention. As shown in FIG. 6, the first interior compartment 28 provides a compartment for storage adjacent the second interior compartment 36 of the pocket 12. When the opening edge 32 is pulled away from the interior pocket surface 60 that is part of the interior surface 20, the second interior compartment 36 is exposed so that various objects or items may be inserted and transported. Additionally, a lining comprising various colors, materials, or textures may be provided within the second interior compartment 36 and/or any other pockets within the bag 10. As another example, a pocket identical or similar to the pocket 12 may be provided on an opposite wall 62 of the bag 10.

Figure 7:
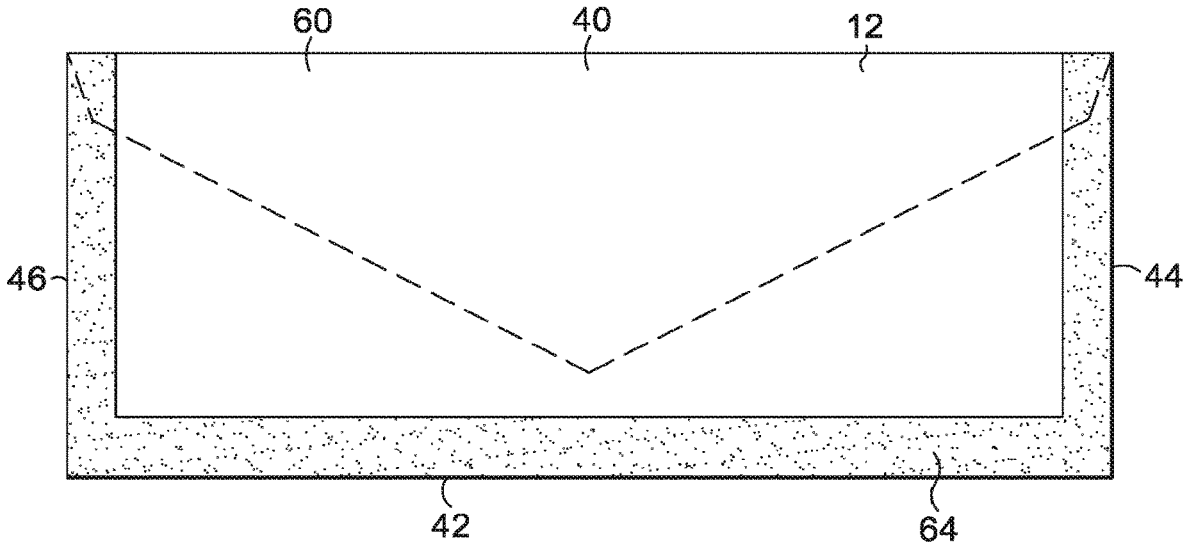
FIG. 7 is a side elevational view of a rear of the envelope-shaped pocket of FIG. 2.

FIG. 7 is a rear elevation view of the separate piece 40 of FIG. 2. A glue surface area 64 is provided around a periphery of the interior pocket surface 60 adjacent the left and right edges 44, 46 and the bottom edge 42. The glue surface area 64 attaches the separate piece 40 to the interior surface 20 to create the pocket 12. It should be noted that other methods of attaching the separate piece 40 to the bag 12 apart from gluing are within the scope of the present invention.

Figure 8:
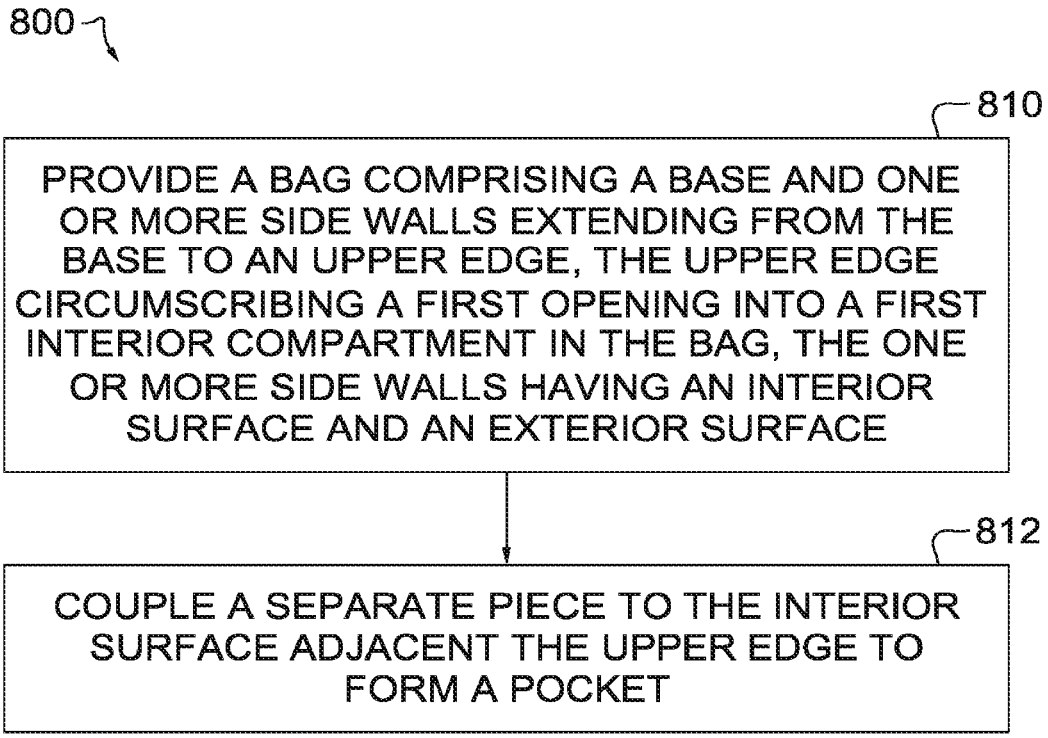
FIG. 8 depicts a block diagram of an exemplary method of manufacturing a gift bag in accordance with an embodiment of the present invention.

Referring to FIG. 8, a block diagram 800 of an exemplary method of manufacturing a gift bag is provided, in accordance with an embodiment of the present invention. At a block 810, a bag, such as the bag 10 shown in FIGS. 1-2, is provided comprising a base, such as the base 14 shown in FIGS. 1-2, and one or more side walls, such as the one or more side walls 16 shown in FIGS. 1-2, extending from the base to an upper edge, such as the upper edge 18 shown in FIGS. 1-2, the upper edge circumscribing a first opening, such as the first opening 26 shown in FIGS. 1-2, into a first interior compartment, such as the first interior compartment 28 shown in FIGS. 1-2, in the bag, the one or more side walls having an interior surface, such as the interior surface 20 shown in FIGS. 1-2, and an exterior surface, such as the exterior surface 22 shown in FIGS. 1-2. At a block 712, a separate piece, such as the separate piece 40 shown in FIGS. 2-3, is coupled to the interior surface adjacent the upper edge to form a pocket, such as the pocket 12.

Many variations can be made to the illustrated embodiment of the present invention without departing from the scope of the present invention. Such modifications are within the scope of the present invention. For example, the pocket 12, instead of being made from a separate piece 40 that is attached to the bag 10, may be integrally formed with the bag 12. In other words, the blank from which the bag is formed may also include panel that is folded over to form the pocket. Further, instead of the separate piece 40 being a flat piece of paper or card stock, the separate piece may have portions folded back around three of the edges to form glue strip panels or flanges. The glue surface area 64 is then on the glue strip panels. Similarly, while the envelope flap 48 is illustrated as a separate piece of stock or material that is adhered to the separate piece 40 to resemble a closed envelope, the envelope flap could be omitted or could be integrally formed with the separate piece 40 and/or the bag 10. Likewise, a line simulating the V-shaped edge of the envelope flap 48 could simply be drawn or printed on the exterior pocket surface 50 when the envelope flap 48 is omitted to give the appearance of the envelope flap 48.

From the foregoing it will be seen that this invention is one well adapted to attain all ends and objects hereinabove set forth together with the other advantages which are clear following the complete disclosure above and which are inherent to the methods and apparatuses described herein. It will be understood that certain features and subcombinations are of utility and may be employed without reference to other features and subcombinations. This is contemplated by and is within the scope of the invention and claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A bag, comprising:

a base;

one or more side walls extending from the base to an upper edge, the upper edge circumscribing a first opening into a first interior compartment of the bag, the one or more side walls having an interior surface and an exterior surface; and a pocket located on the interior surface and comprising an opening edge that at least partially circumscribes a second opening into a second interior compartment located within the pocket, wherein the pocket is formed in part from a separate piece attached to the interior surface, wherein the separate piece is rectangular, wherein the pocket includes an envelope flap formed from another separate piece that is attached across the separate piece to form a layered configuration with the separate piece, wherein the envelope flap is non-foldable relative to the opening edge, and wherein the envelope flap forms a triangle shape that converges at a point.

2. The bag of claim 1, wherein the one or more side walls comprise four side walls extending from the base, the four side walls separated by corner edges.

3. The bag of claim 1, wherein the base is rectangular.

4. The bag of claim 1, wherein the bag further comprises at least one handle coupled to the one or more side walls.

5. The bag of claim 1, wherein the pocket is spaced from the upper edge.

6. The gift bag of claim 1, wherein an edge of the envelope flap is aligned with an edge of the separate piece.

* * * * *